US005901487A

United States Patent [19]

Thalenfeld et al.

[11] Patent Number: 5,901,487

[45] Date of Patent: May 11, 1999

[54] MERCHANDISE DISPLAY HOOK WITH INTEGRAL SUPPORT FOR PIVOTING LABEL HOLDER

[75] Inventors: David R. Thalenfeld, Bear Creek, Pa.; Thomas O. Nagel, Blairstown, N.J.

[73] Assignee: Trion Industries, Inc., Wilkes-Barre, Pa.

[21] Appl. No.: 08/681,008

[22] Filed: Jul. 22, 1996

Related U.S. Application Data

[63] Continuation-in-part of application No. 08/640,336, Apr. 30, 1996.

[51] Int. Cl.[6] ..... G09F 3/00

[52] U.S. Cl. ..... 40/642.01; 40/666; 211/57.1; 211/59.1

[58] Field of Search ..... 40/642.01, 642.02, 40/661.08, 666; 211/57.1, 59.1; 248/214, 231.81

[56] References Cited

U.S. PATENT DOCUMENTS

| | | | |
|---|---|---|---|
| 1,033,915 | 7/1912 | McDonald | 402/68 |
| 4,394,909 | 7/1983 | Valiulis et al. . | |
| 4,540,093 | 9/1985 | Merl et al. . | |
| 4,593,824 | 6/1986 | Pfeifer | 211/57.1 |
| 4,801,116 | 1/1989 | Blankenship . | |
| 4,821,437 | 4/1989 | Abramson et al. . | |
| 4,850,557 | 7/1989 | Valiulis | 211/57.1 X |
| 5,088,606 | 2/1992 | Boas . | |
| 5,235,766 | 8/1993 | Fast et al. . | |
| 5,236,163 | 8/1993 | Valiulis | 248/220.4 |
| 5,441,161 | 8/1995 | Merl | 211/57.1 |
| 5,442,872 | 8/1995 | Moser . | |
| 5,456,034 | 10/1995 | Lewis et al. . | |
| 5,485,930 | 1/1996 | Rushing | 211/59.1 |
| 5,645,175 | 7/1997 | Wood | 211/57.1 |
| 5,702,008 | 12/1997 | Thalenfeld et al. | 211/57.1 |
| 5,815,970 | 10/1998 | Thalenfeld et al. | 40/642.01 |
| 5,826,359 | 10/1998 | Thalenfeld et al. | 40/642.01 |

*Primary Examiner*—Brian K. Green
*Assistant Examiner*—Andrea Chop
*Attorney, Agent, or Firm*—Schweitzer Cornman Gross & Bondell LI

[57] ABSTRACT

A merchandise display hook provided with an improved support structure for a pivoting label holder. A label-mounting arm extends and terminates above a merchandise display arm. An integral cross bar, which is formed by bending the end of the label mounting arm wire, provides a pivot mount for a plastic label holding device. The arrangement provides enhanced function, while at the same time achieving desirable manufacturing economies. In one embodiment, the label mounting arm wire is bent once at a right angle to form the cross bar. In another embodiment, the wire is bent twice—once to form an integral, intermediary section and once to form the cross bar. In a third embodiment, the wire is bent a third time to form another integral section, angled rearwardly toward the label mounting arm forming a triangular end portion. The cross bar can include a portion projecting through the label holder to retain and center the label holder.

4 Claims, 3 Drawing Sheets

10
11
12
13
17
24
30
31
32
33
34
35
36
37
38
39
40
41
48

MERCHANDISE DISPLAY HOOK WITH INTEGRAL SUPPORT FOR PIVOTING LABEL HOLDER

RELATED APPLICATION

This application is a continuation-in-part of our copending U.S. application Ser. No. 08/640,336 filed Apr. 30, 1996 currently pending.

FIELD OF THE INVENTION

This invention pertains to merchandise display hooks and, in particular, to merchandise display hooks with label support arms.

BACKGROUND AND SUMMARY OF THE INVENTION

Display hooks, typically mounted on apertured panel board, slotted panels or the like are in widespread usage for displaying carded merchandise for sale. In many cases, such merchandise display hooks are combined with label-mounting means for presenting product information and pricing in association with the carded merchandise. A common form of such label-mounting means consists of an arm projecting above and generally parallel to a merchandise supporting arm and mounting a label-holding device at its forward extremity, advantageously in a position directly in front of the outer end of the merchandise display hook. The label-holding device, in such cases, serves an additional function as a means for guarding the outer end of the display hook element against accidental contact.

One of the known label-mounting means for this purpose comprises a wire-like element extending outward, above the merchandise support, and terminating at its outer extremity in a welded-on cross bar element. The cross bar element serves as a pivoting support for a plastic label holder, allowing the label holder to hang downward in front of the outer end of the merchandise support. The pivoting action of the label holder facilitates product removal from the associated product support. If a product being withdrawn forwardly from its display hook engages the plastic label holder, the holder can simply pivot upward out of the way as necessary to allow the product to clear. An additional advantage of pivoting label holders in general is that, with respect to product items displayed at a low level, viewing of the product information and pricing is facilitated by allowing the customer to simply reach down and tilt the label holder upwardly, rather than having to bend or crouch to read the contents of the label.

The present invention is directed to a merchandise display hook of the general type described above, including a pivoted label holder arrangement, which is both improved with respect to known constructions and is at the same time capable of more economical manufacture. To this end, the device of the invention includes a cross bar element, for pivotal support of a label holder, which is not mounted at the end extremity of its support arm, as in devices of known construction, but is an integral part of the support arm. In one embodiment of the invention, the cross bar element consists of an integral section of the label support arm which is bent at a right angle with respect to the shaft of the label support arm.

In another embodiment of the invention, the cross bar element consists of an integral section of the label support arm disposed at a right angle with respect to the shaft of the label support arm where the cross bar element is connected to the shaft by an intermediate section bent at an angle with respect to both the shaft and the cross bar element. In yet another embodiment of the invention, the cross bar element is connected to the shaft of the label support arm by an intermediate section at an angle (as above) and a second section extends from an opposite end of the cross bar element towards the shaft of the label support arm forming a triangular end portion.

The cross bar may include a projecting portion extending through an opening in a clip portion of the label holder to retain the label holder in a centered position.

For a more complete understanding of the above and other features and advantages of the invention, reference should be made to the following detailed description of a preferred embodiment of the invention and to the accompanying drawings.

DESCRIPTION OF A PREFERRED EMBODIMENT

Figures 1, 2, 3, 4:
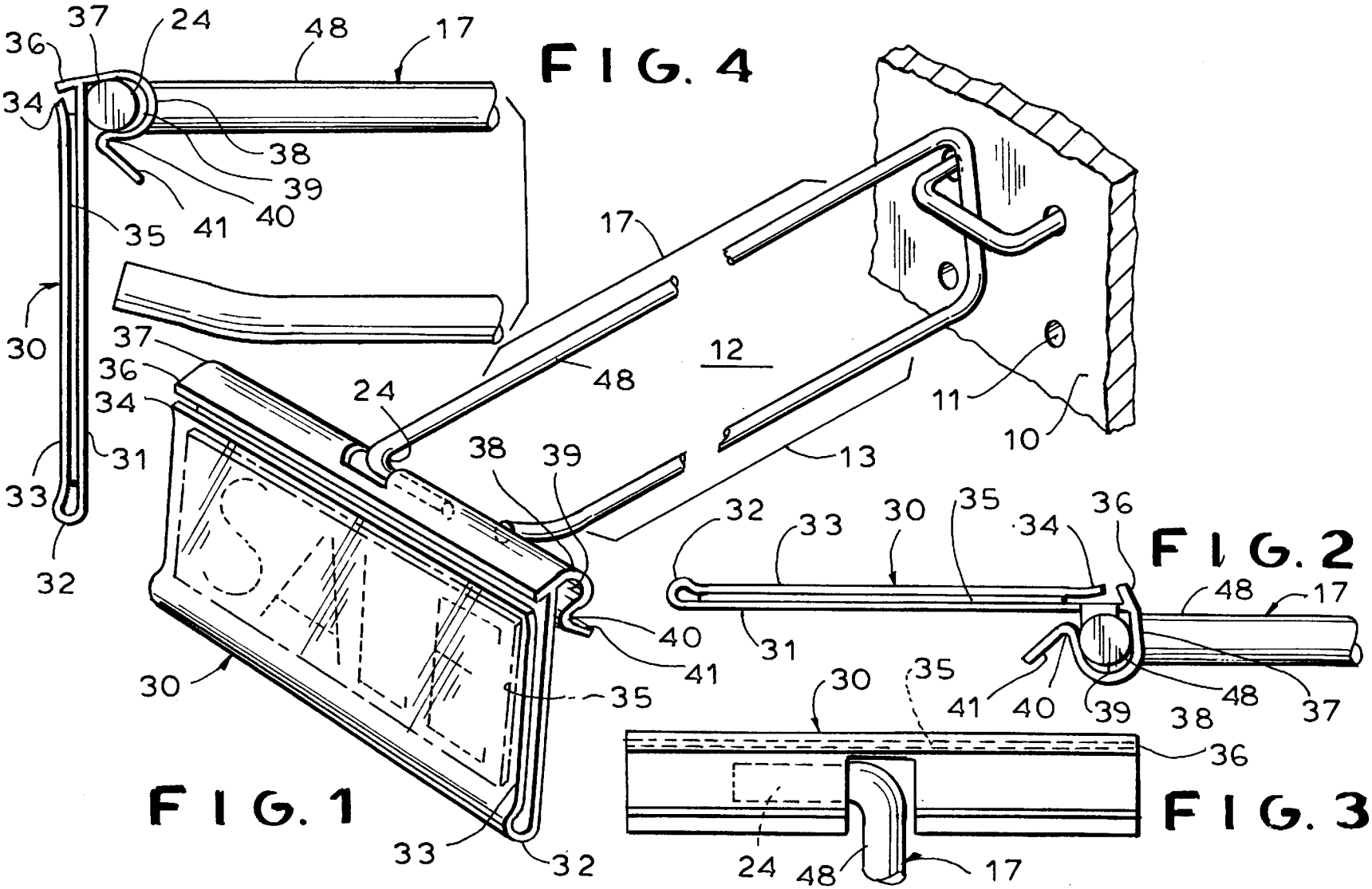
FIG. 1 is a perspective view of one preferred embodiment of a merchandise display hook according to the invention.
FIG. 2 is an enlarged, fragmentary side elevational view, illustrating front portions of the display hook of FIG. 1, showing a label-holding device in a normal or rest position.
FIG. 3 is a fragmentary side elevational view, similar to FIG. 2, illustrating the label-holding device in an upwardly pivoted position.
FIG. 4 is an enlarged fragmentary plan view of the device as shown in FIG. 1.

Referring now to the drawing, the reference numeral 10 designates a section of apertured panel board provided with a grid of openings 11. Conventionally, the openings 11 are provided over the entire surface of the panel 10 and are spaced uniformly, both horizontally and vertically. A merchandise display hook 12 is conventionally provided with mounting lugs (hidden) which are inserted through an adjacent pair of apertures 11 in the board 10 in order to support the merchandise hook 12 in the manner illustrated in FIG. 1, with operative portions of the display hook extending outward from the face of the panel board.

In the form of the invention illustrated in FIGS. 1–4, the hook 12 includes a merchandise supporting element 13 and a label supporting arm 17 which extends above and generally parallel to the merchandise support 13, with the outer end portion 18 of the arm 17 positioned slightly beyond and slightly above the end extremity 16 of the merchandise supporting element 13. As shown in FIGS. 1–4, the outer end portion 16 of the merchandise supporting element 13 may be bent upward at an angle to the horizontal.

Whereas in accordance with prior knowledge, a label supporting cross bar element is welded to the straight wire section 17, it is a feature of the present invention that the cross bar is an integral portion of the wire section 17. Specifically, in the version of the invention shown in FIGS. 1–4, cross bar 24 may be formed as an integral section of label support arm 17 by bending label support arm 17 at a right angle thereby forming a shaft 48 and cross bar element 24. One of the advantages of this arrangement is that the welding procedure is avoided, and is replaced by a bending procedure which is much simpler and more reliable. Also, significant manufacturing economies are realized through the easier and more reliable bending procedure.

Mounted on the cross bar 24 is a plastic label holder, generally designated by the reference numeral 30. The label holder may in large part be of known design and construction. It is preferably of extruded or coextruded semi-rigid, plastic construction and comprises a flat back panel 31 joined along a bottom edge 32 with a clear front panel 33. The front and back panels 33, 31, and the bottom connection 32 are so arranged that the front panel tends to close elastically against the front face of the back panel 31. However, by pressing rearwardly against the bottom portion 32 and forwardly against upper portions of the back panel 31, the upper lip 34 of the front panel can be sprung forward from the back panel 31 to accommodate the placement and retrieval of product information and pricing labels 35. Desirably, a forwardly projecting guard flange 36 is provided along the upper edge of the back panel 31, to normally overlie the upper edge 34 of the front panel.

A hinge-forming flange 37 projects rearwardly from the upper edge of the back panel 31 and includes a U-shaped retaining clip portion 38 defining a forwardly facing U-shaped recess 39 of a size to receive the cross bar element 24. At its lower edge extremity 40, the U-shaped flange portion 38 is bent sharply downward and rearward, and supports an integral, downwardly divergent guide flange 41. By placing the guide flange 41 in contact with the cross bar 24 and pressing downward on the top of the retaining flange 37, the label holder 30 may be snapped on to the cross bar 24, so that the label holder is reliably connected to the cross bar 24 while being free to pivot with respect thereto. The retaining clip portion 38 can be slotted at 43 to accommodate the label support arm 17 and to maintain the label holder properly centered with respect to cross bar 24.

Figure 5:
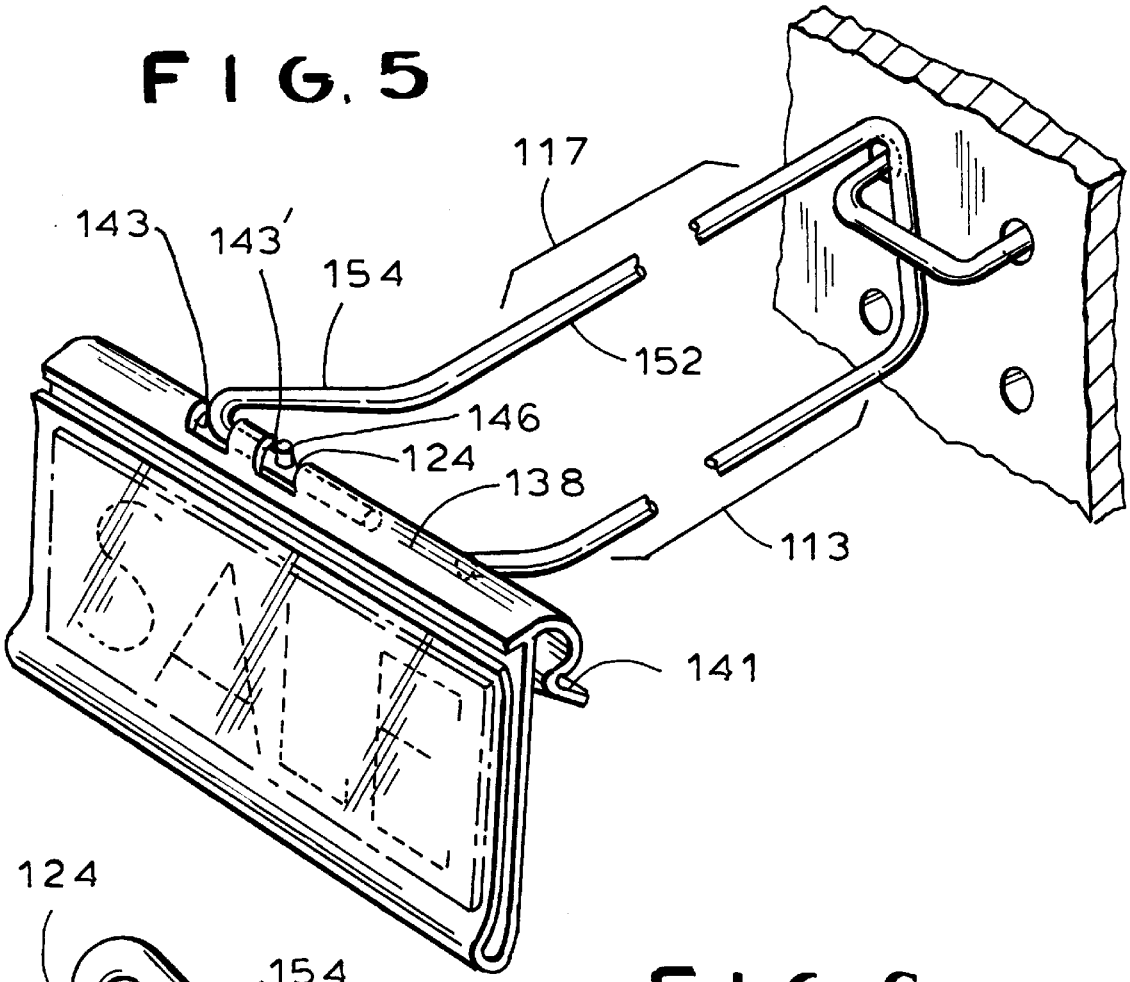
FIG. 5 is a perspective view of a second preferred embodiment of a merchandise display hook according to the invention.
Figure 6:
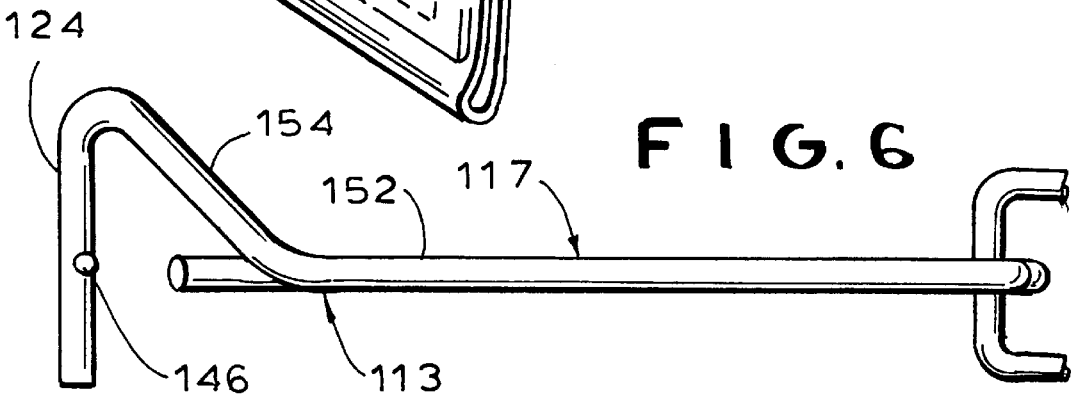
FIG. 6 is a plan view of the merchandise display hook of FIG. 5.
Figure 7:
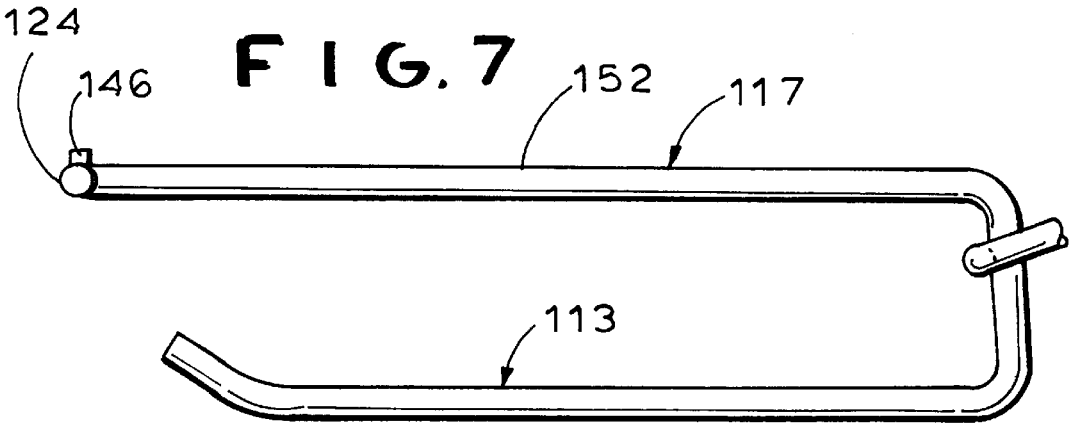
FIG. 7 is a side elevational view of the merchandise display hook of FIG. 5.

In the embodiment shown in FIGS. 5–7, cross bar 124 may be formed by bending label support arm 117 in two places so as to form a shaft 152, an intermediate section 154 and cross bar 124. Cross bar 124 may include a projecting portion 146. The retaining clip portion 138 and the guide flange 141 can be slotted at 143 and 143' to accommodate the label support arm 117 and the projecting portion 146, respectively. The projecting portion 146 preferably is created by mechanically deforming a section of cross bar 124. To allow free rotation of the label holder 130, the slot 143 should be slightly wider than the distance between the projecting portion 146 and the integrally connected end of the cross bar 124. Alternately, if the cross bar 124 does not include a projecting portion 146, the retaining clip portion 38 need only have one slot to accommodate the label support arm 117.

Figure 8:
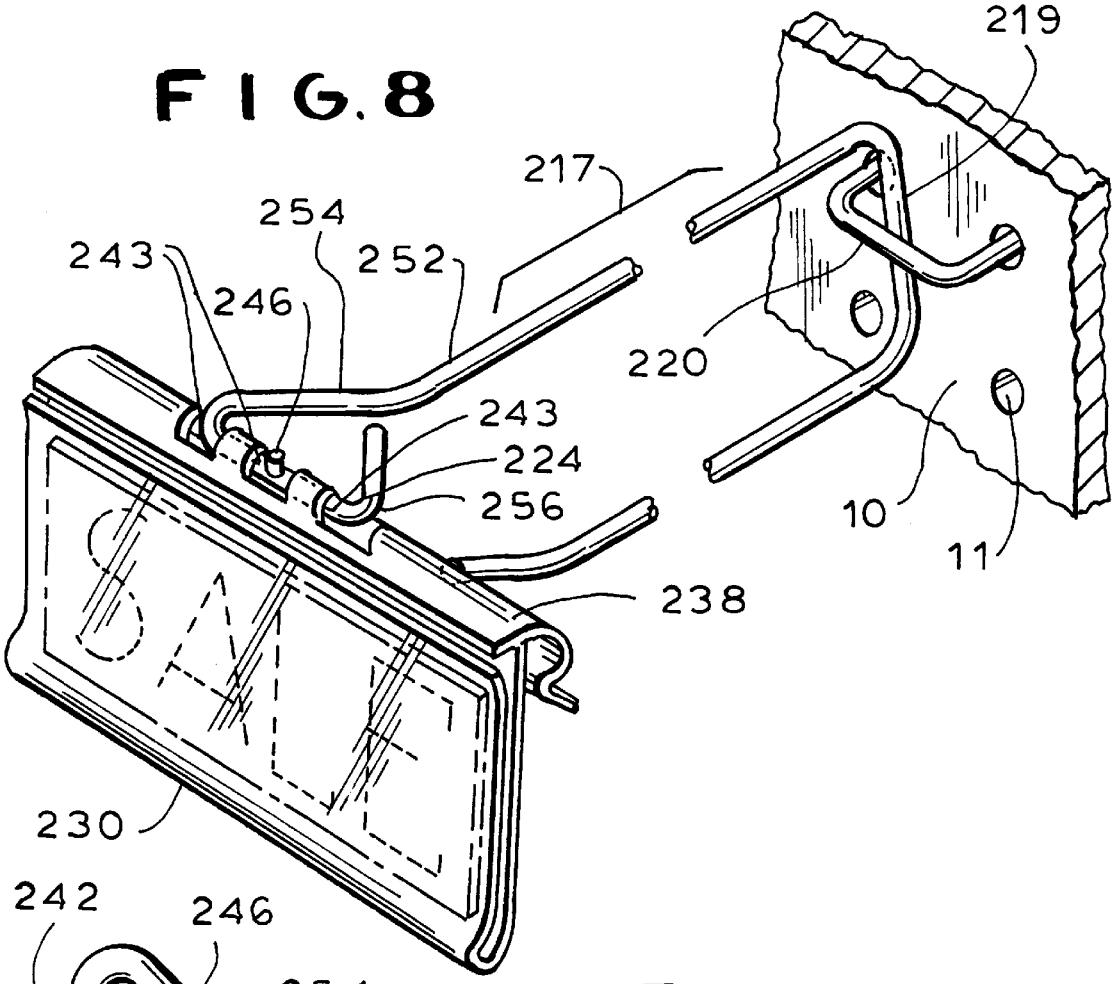
FIG. 8 is a perspective view of a third preferred embodiment of a merchandise display hook according to the invention.
Figure 9:
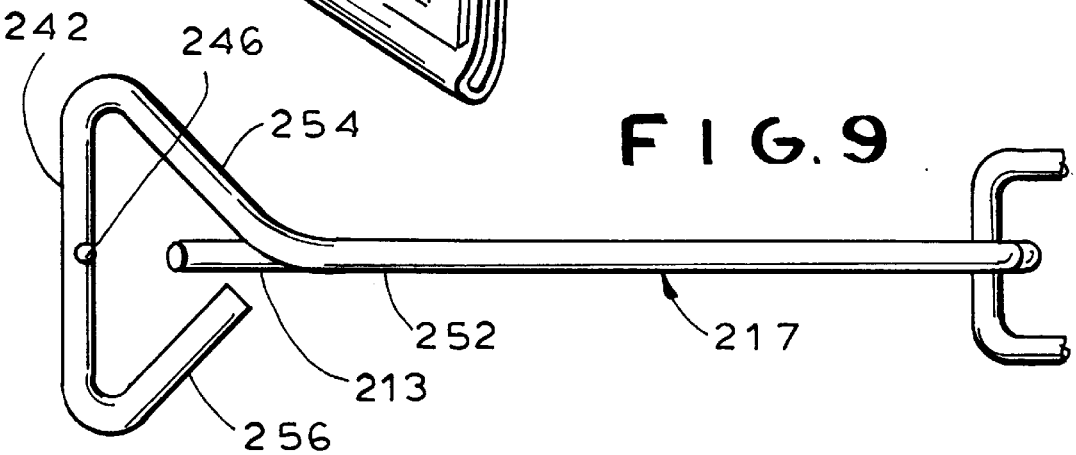
FIG. 9 is a plan view of the merchandise display hook of FIG. 8.
Figure 10:
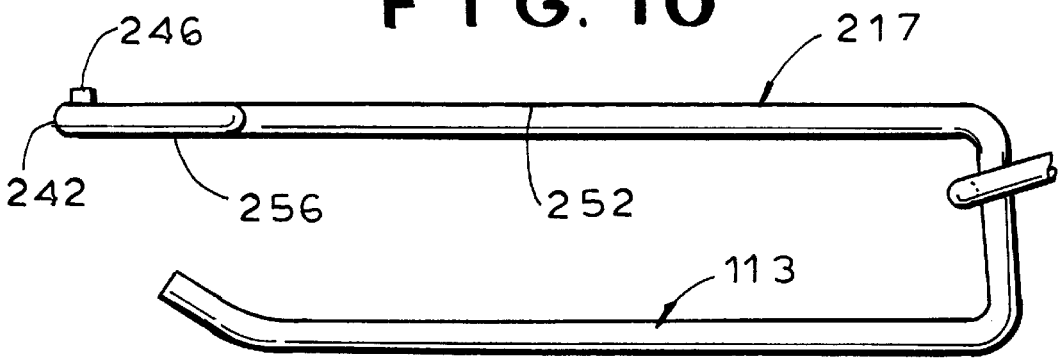
FIG. 10 is a side elevational view of the merchandise display hook of FIG. 8.

In another embodiment shown in FIGS. 8–10, label support 217 includes three bends so as to form shaft 252, intermediate section 254, cross bar 224 and end section 256 thereby creating a triangular section at the end thereof. Again, cross bar 224 can include a projecting portion 246 and label holder 230 can include one or more slots 243. In this embodiment, the label holder 230 can include three slots, one to accommodate the projecting portion 246 and the other two to accommodate the ends of the intermediate sections 254 and the end section 256. Or, if the cross bar 224 does not include a projecting portion 246, label holder 230 can have two slots, one for each of the intermediate and end sections 254, 256. Alternatively, if the retaining clip portion 238 is less than the length of cross bar 224, it need have no slots.

In all embodiments, label support 217 and merchandise supporting element 213 can be integrally formed from one piece such that they are connected by a leg 219. A connecting bar 220, welded to leg 219, supports mounting lugs (not shown) for engaging openings 11 and panel 10.

The described arrangement is particularly desirable, as compared to the conventional arrangement of welding the cross bar 24 directly to the label support wire 17 because, in addition to decreasing the time and expense of manufacturing, it decreases the number of exposed, and potentially harmful wire ends thereby increasing safety.

It should be understood, of course, that the specific form of the invention herein illustrated and described is intended to be representative only. In this respect, the specific form of the merchandise display hook employing the new label-mounting feature may take any of a variety of forms. Likewise, the plastic label holder itself may be constructed in various ways consistent with the present invention. Accordingly, reference should be made to the following appended claims in determining the full scope of the invention.

We claim:

1. A merchandise display hook with pivoting label holder, which comprises, (a) an outwardly extending label holder arm having a shaft and a cross bar member, (b) means associated with an inner end of said label holder arm for mounting said arm on a support structure, (c) said cross bar member being integral and in one piece with said shaft of said label holder arm and extending transversely thereof for the support of a label holder, (d) a label holder mounted on said cross bar and having a label panel for retaining a product information label, (e) said label holder including a cross bar engaging clip portion extending rearwardly and downwardly with respect to said label panel and engaging only said cross bar, (f) said cross bar engaging clip portion and said label holder being freely pivotally mounted on said cross bar to accommodate easy product removal from a position below said label holder arm, (g) said cross bar being connected to said shaft by an intermediate section, (h) said shaft, said intermediate section and said cross bar being integral and comprising a single piece of material, (i) said intermediate section being substantially at a 45 degrees angle with respect to said shaft and said cross bar, (j) said cross bar further comprising a first end portion and a projecting portion, (k) said cross bar engaging clip portion including a slot being sized to accommodate said projecting portion, and (l) said projecting portion extending into said slot to locate said label holder while accommodating free upward pivoting movement of said label holder.

2. A merchandise display hook according to claim 1, wherein said projecting portion extends through said slot of said label holder and is positioned to center said label holder with respect to said display hook.

3. A merchandise display hook with pivoting label holder, which comprises, (a) an outwardly extending label holder arm having a shaft and a cross bar member, (b) means associated with an inner end of said label holder arm for mounting said arm on a support structure, (c) said cross bar member being integral and in one piece with said shaft of said label holder arm and extending transversely thereof for the support of a label holder, (d) a label holder mounted on said cross bar and having a label panel for retaining a product information label, (e) said label holder including a cross bar engaging clip portion extending rearwardly and downwardly with respect to said label panel and engaging said cross bar, (f) said cross bar engaging clip portion and said label holder being freely pivotally mounted on said cross bar to accommodate easy product removal from a position below said label holder arm, (g) said cross bar further comprising a first end portion and a projecting portion, (h) said cross bar engaging clip portion including a slot being sized to accommodate said projecting portion, and (i) said projecting portion extending into said slot to locate said label holder while accommodating free upward pivoting movement of said label holder.

4. A merchandise display hook according to claim 3, wherein said projecting portion extends through said slot of said label holder and is positioned to center said label holder with respect to said display hook.

* * * * *